US008016894B2

(12) United States Patent
Selwyn et al.

(10) Patent No.: US 8,016,894 B2
(45) Date of Patent: Sep. 13, 2011

(54) SIDE-SPECIFIC TREATMENT OF TEXTILES USING PLASMAS

(75) Inventors: Gary S. Selwyn, Los Alamos, NM (US); Hans W. Herrmann, Los Alamos, NM (US); Matthew R. Barnes, Santa Fe, NM (US)

(73) Assignee: APJeT, Inc., Sante Fe, NM (US)

( * ) Notice: Subject to any disclaimer, the term of this patent is extended or adjusted under 35 U.S.C. 154(b) by 1631 days.

(21) Appl. No.: 11/317,374

(22) Filed: Dec. 22, 2005

(65) Prior Publication Data

US 2007/0148366 A1 Jun. 28, 2007

(51) Int. Cl.
*C08J 7/18* (2006.01)
*H05H 1/24* (2006.01)

(52) U.S. Cl. ..... 8/115.52; 427/569; 8/115.51

(58) Field of Classification Search ..... 427/569, 427/534; 118/723 R; 216/67; 28/100; 8/115.51
See application file for complete search history.

(56) References Cited

U.S. PATENT DOCUMENTS 5,065,600 A 11/1991 Byles
5,312,667 A 5/1994 Lumb et al.
6,151,928 A 11/2000 Anyon et al.
6,187,391 B1 2/2001 Kataoka et al.
6,955,999 B1 10/2005 Boye
2001/0031543 A1 10/2001 Ando et al.
2003/0145389 A1* 8/2003 Chen et al. ..... 8/115.51
2003/0213561 A1* 11/2003 Selwyn et al. ..... 156/345.43
2004/0137647 A1 7/2004 Miyazaki et al.
2004/0194223 A1* 10/2004 Cernak ..... 8/115.51
2005/0199340 A1 9/2005 Selwyn et al.

FOREIGN PATENT DOCUMENTS

JP 10087857 * 4/1998

* cited by examiner

*Primary Examiner* — Harold Y Pyon
*Assistant Examiner* — Katie Hammer
(74) *Attorney, Agent, or Firm* — Samuel M. Freund; Cochran Freund & Young LLC

(57) ABSTRACT

An apparatus and method for generating gas-phase active chemical species suitable for selectively processing one side of a textile or nonwoven material are described. Processing includes etching or stripping coatings, as examples. A low-temperature plasma is used to produce an ionized gas containing radical species, atoms, ions, and electrons, some of which are suitable for removing or modifying the coating. For the purposes of the present invention, the plasma may be generated in a vacuum, or at atmospheric pressure. Dielectric-barrier discharges, atmospheric-pressure plasma jets, micro hollow-cathode discharges, coronas, or plasmas produced by a microwave discharge or laser-supplied energy may be used to generate the required species.

17 Claims, 6 Drawing Sheets

SIDE-SPECIFIC TREATMENT OF TEXTILES USING PLASMAS

FIELD OF THE INVENTION

The present invention relates generally to finishing textile and nonwoven fabrics and, more particularly, to the use of a plasma-generated species for side-specific treatment of woven, knitted and nonwoven fabrics, and felts and carpets.

BACKGROUND OF THE INVENTION

Textiles include apparel items, home furnishings, carpets, and non-woven fabrics, such as disposable clothing and utility wipes, are generally two-dimensional, pliable and made from fibers or fibrous materials consisting of natural or man-made components. The manufacture of textiles includes fiber production and preparation as well as finishing processes which are applied to textiles near the completion of the manufacturing process.

Finishing steps may include addition of an anti-wrinkling agent; addition of a softening agent to improve the "hand" of the fabric; addition of a flame-retardant chemical to reduce the flammability of the product; or addition of a fluorochemical or hydrocarbon-based treatment to reduce staining of the textile or to enhance resistance to penetration by liquids. A number of finishing processes may be applied at the same time; there may be greater than ten steps in some apparel finishing operations. The use of multiple finishes in textiles has increased in recent years to meet consumer demands for fabrics that do not wrinkle or stain, that have a smooth and comfortable feel, and that can be easily cleaned.

Some finishes are designed to counter the natural properties of fibers that are used in manufacture of the textile. For example, cotton is naturally absorbent and breathes well, making it cool and comfortable to wear; however, those traits also permit cotton fabric to be easily stained, absorb water, and dry slowly. As another example, polyester fabric tends to be hydrophobic, and therefore naturally stain repellent. However, polyester does not absorb perspiration well and therefore may feel "hot" to some wearers. To overcome these drawbacks, textile manufacturers frequently add finishing chemicals that render cotton hydrophobic, and therefore less prone to absorb water or stains, or render polyester more hydrophilic, and therefore more comfortable to wear. The use of finishing processes is not limited to apparel: draperies may be prone to fading, and therefore can benefit from addition of a fade-resistant coating. However, that same coating may degrade the appearance of the product as seen from the inside, where fade-resistance is not needed. A non-woven wipe may be treated with a hydrophilic chemical to increase its ability to absorb spills, but it may be desirable to prevent the absorbed liquid from penetrating to the other side of the wipe.

It would be desirable to develop a treatment method, whereby two dimensional textiles can be exposed to finishing treatments that are different, or have different properties on each side. For example, an item of clothing might have a stain- and water-repellent coating on the outside, and be water-absorbent on the inside, such that it is stain-free, while remaining comfortable to wear. Similarly, a drapery that has a reflective or shiny, fade-resistant coating on the side facing the outside, might have a soft, satiny appearance on the side facing the inside of a room where fade-resistance is not needed.

The ability to clean, or remove stains from the product is enhanced by allowing the stain-release process to happen from the inside of the fabric. Difficulties in achieving dual-functionality treatments therefore result from the methods most commonly used for application of finishing treatment: the dip and cure process, or the dip and dry process. That is, most finishes are applied by pulling the fabric through a liquid chemical bath that contains a formulation for imparting the desired finish when the fabric is dried or cured, for example, in a subsequent heat step. Because there is no easy or inexpensive way to keep the liquid chemicals on only one side of the fabric, the entire material, including both sides, is treated at once.

Previous methods for achieving side-specific functionality include those described in U.S. Pat. Nos. 5,065,600, 5,312,667 and 6,151,928, where hydrophilic and hydrophobic yarns are knitted into a composite textile having opposing absorbent and non-absorbent faces. These methods are specific to knitted fabric and require very specific knit patterns. A composite textile in which hydrophobic and hydrophilic fabrics are sewn together resulting in an outer zone providing a leak-proofing function and a hydrophilic inner zone allowing mass and heat to be transferred to an intermediate zone between the two fabrics is described in U.S. Pat. No. 6,955,999. This method is applicable to more general types of fabrics, but is likely to result in reduced comfort.

A plasma-based method to achieve side-specific finishing is described in U.S. Pat. No. 6,187,391; however, the method requires the application of a sizing agent to one side of the fabric to mask the effect of plasma treatment on that side. The masking step is followed by plasma treatment and subsequent graft-polymerization of a coating onto the unmasked, plasma-treated sided. Finally, the sizing must be removed to regain the original functionality on the masked side. Single-sided application of sizing is a complex process, presenting the same difficulties which would be encountered if one applied a functional finish selectively to one side of the fabric. Moreover, graft polymerization, where radical-initiated polymerization is induced by residual radicals left on the fabric surface after plasma treatment, is a relatively slow process which takes tens of minutes or even hours of exposure to gas-phase monomers.

Accordingly, it is an object of the present invention to provide a method and apparatus for selectively processing one side of a treated fabric in such a manner that the other side of the fabric remains essentially unaffected.

Another object of the invention is to provide a method and apparatus for selectively removing a coating from one side of a coated fabric, such that the coating on the other side of the fabric remains essentially unaffected.

Still another object of the present invention is to provide a method and apparatus for selectively attaching chemical functional groups to the surface of a coated fabric or coated nonwoven material on only one side, such that the chemical functional groups impart a different property to that side than was originally present thereon.

Yet another object of the invention is to provide a method and apparatus for selectively removing a portion of or all of a hydrophobic coating from one side of a coated textile, such that the textile may be treated with a second coating which will only adhere to the non-hydrophobic side.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the method for selectively processing a coating on a chosen side of a two-sided, coated textile or a two-sided, coated nonwoven material without significantly affecting the coating on the other side, includes the steps of: generating reactive chemical species in a low-temperature plasma proximate to one side of the coated textile or coated nonwoven material; exposing the chosen side of the textile or nonwoven material to the plasma for a period of time effective for processing the coating on the chosen side; maintaining the other side of the textile or nonwoven material in proximity to a plasma-impermeable surface such that the coating on the other side of the textile or nonwoven material is substantially unaffected by the reactive species.

In another aspect of the present invention, in accordance with its objects and purposes, the apparatus for selectively processing a coating on a chosen side of a two-sided, coated textile or a two-sided, coated nonwoven material without significantly affecting the coating on the second side, hereof includes: a low-temperature plasma source for generating reactive chemical species proximate to the chosen side of the coated textile or the coated nonwoven material, effective for processing the chosen side of the coated textile or the coated nonwoven material; a plasma impermeable surface; and means for maintaining the second side of second textile or nonwoven material in proximity to the plasma-impermeable surface such that the coating on the second side of said textile or the nonwoven material is substantially unaffected by the reactive species, and the chosen side of the textile or the nonwoven material is processed .

Benefits and advantages of the present invention include, but are not limited to, selectively removing or otherwise treating one side of a fabric coated on both sides.

BRIEF DESCRIPTION OF THE DRAWING

The accompanying drawings, which are incorporated in and form a part of the specification, illustrate several embodiments of the present invention and, together with the description, serve to explain the principles of the invention.

DETAILED DESCRIPTION

Figure 1:
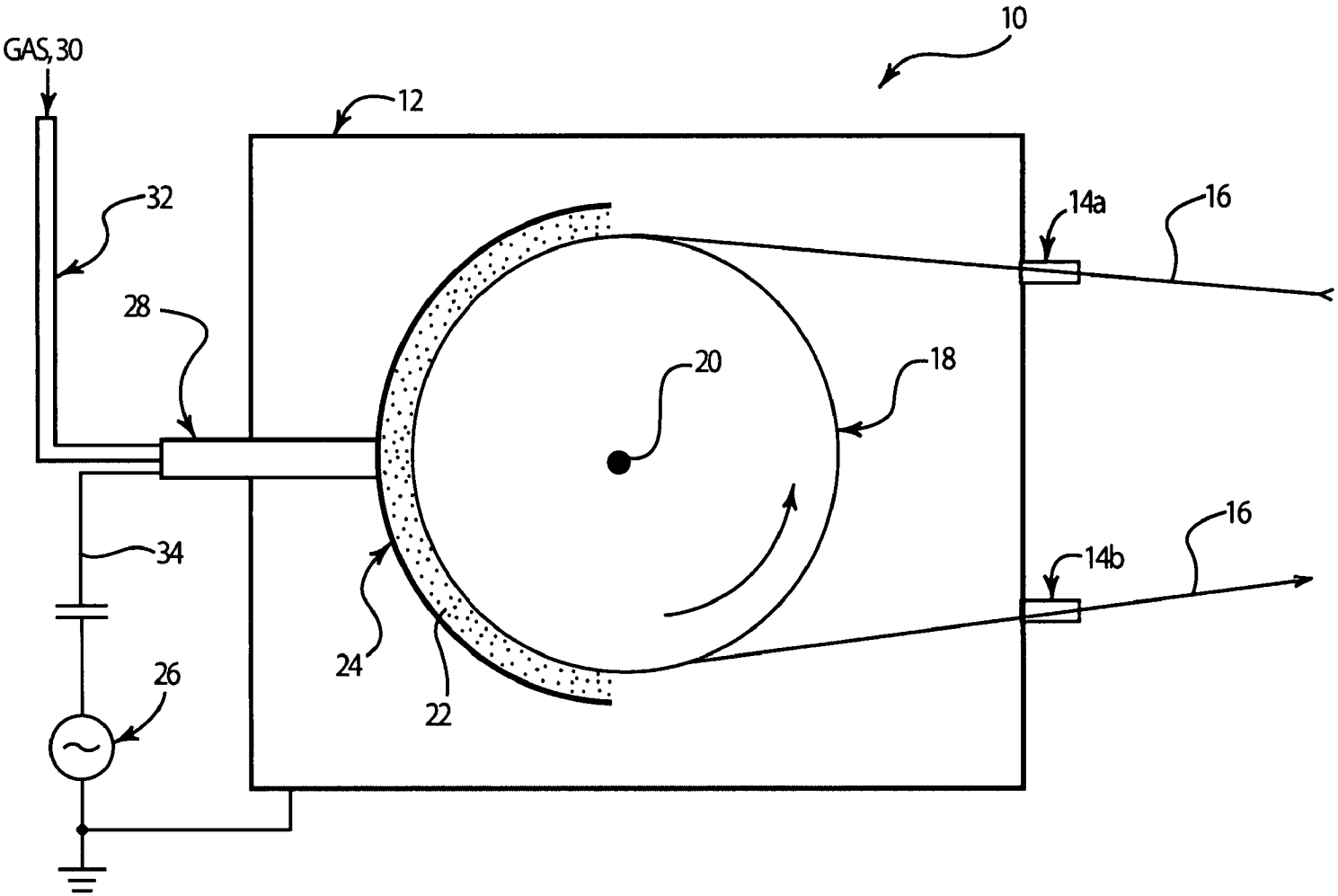
FIG. 1 is a schematic representation of a plasma apparatus for selective removal or treatment of the coating on one side of a fabric coated on both sides, using concentric cylindrical electrode geometry, wherein the fabric is held against the grounded electrode.

Briefly, the present invention includes the use of low-temperature (≦250 C) plasmas for generating gas-phase active chemical species suitable for selectively processing one side of a coated textile or nonwoven material. Processing, as used herein, includes modifying, etching or stripping a coating from a surface, as examples. A plasma is an ionized gas containing radical species, atoms, ions, and electrons, some of which are suitable for removing or modifying coatings applied to a textile or nonwoven material. For the purposes of the present invention, the low-temperature plasma may be generated in a vacuum, or at atmospheric pressure. Dielectric-barrier discharges, atmospheric-pressure plasma jets, micro hollow-cathode discharges, coronas, or plasmas produced by a microwave discharge or laser-supplied energy may be used to generate the required species.

Conventional fabric finishing processes may be applied to both sides of the fabric, as well as throughout the fabric, and include films, polymers, or impregnated chemicals. Impregnated chemicals may form a surface coating on the outside surfaces of the fabric, or may form both a surface coating and fill the interior of the fabric. Finishes may include fire-retardant chemical treatment, a coating to reduce fabric fading in ultraviolet light, an antimicrobial coating, a stain or water-repellent coating, a soil-release coating, or a water-absorbing coating, and combinations thereof, as examples. Fabric finishing processes may provide fabrics with coatings having different thickness and different properties on each side of the fabric. The present invention may be applied to all of these situations, as well as to selective treatment of an unfinished fabric surface.

Such initial processing may be followed by modification or stripping of the finish selectively on one side of the fabric using plasma treatment in accordance with the teachings of the present invention. It has been found by the present inventors that if one side of the coated textile is exposed to the plasma, while the other side of the textile is maintained in close proximity to a surface impervious to the plasma species, the plasma may selectively remove or modify one side of the applied coating. The side of the fabric facing the impermeable surface is protected from modification or removal by the chemical species generated in the plasma. It should be mentioned that whether the fabric is pressed against the impermeable surface with some force or simply adjacent to the surface, or in the vicinity thereof, will depend on how much of the protected surface can be removed or modified without rendering insignificant the difference in properties between that surface and the surface deliberately being processed or removed. To process large quantities of fabric, the textile may be moved through the plasma at chosen speeds such that the textile spends an effective amount of time in the plasma. In some situations the plasma treatment may provide functional ligands having additional desirable properties to the surface of the fabric on the side facing the plasma; the coating on the protected side is retained essentially as coated, and may have different functionality than the plasma-processed side. The present apparatus and method may therefore be used to achieve a desired dual-functionality fabric.

In some situations the coated textile may be pressed against one of the plasma-forming electrodes, such as the ground electrode or the electrically powered electrode, such that the coating on the side of the textile facing the electrode is shielded from chemical removal, or stripping, caused by the plasma. If the residence time of the fabric in the plasma is correctly chosen, the coating on the side of the fabric facing the shielding electrode will remain essentially untouched, whereas the coating facing the plasma will be modified or removed, if the residence time in the plasma is correct. Of course, greatly exceeding the time required for the plasma to remove the coating on the side of the fabric facing the plasma may have a detrimental effect on the shielded side of the fabric, as a result of diffusion of active chemical species through the fabric, even at atmospheric pressure. Similarly, under-exposure of the fabric to the plasma will result in insufficient or partial removal of the coating on the fabric on the side facing the plasma. The amount of time required for exposure in the plasma to have the desired effect of selective removal of the fabric coating on only one side depends on the concentration and type of active chemical species in the plasma and on the thickness and reactivity of the coating. Treatment times may vary between about 0.1 s to 50 s. However, for high volume operations such as those typically found in textile finishing, the fabric is continuously moving at speeds typically between 50 and 120 yards/min. Thus, for a residence time of 10 s, and a linear speed for the fabric of 100 yards/min., the plasma would have to be approximately 60 ft. long to process the fabric; shorter residence times, or slower line speeds may be advantageous.

In some situations it may be desirable to remove or treat chosen sections of a coating from one side of the fabric rather than the entire coating. This may be done to impart limited functionality to the coating, such as permitting liquid absorption in only selected regions of the fabric, as an example, and may be achieved by selectively removing an initially applied hydrophobic coating from only the chosen regions of the fabric on the side facing the plasma. Subsequent treatment of the fabric may then occur in only those portions from which the coating was removed or treated, since the remaining portions of the fabric will continue to be non-absorbing because of the initial water-repellent treatment. Such a treatment may be used to selectively dye a pattern into the fabric, as an example. As will be described in greater detail hereinbelow, a plasma generated using electrodes having a series of grooves or notches, or one generated using a series of hollow-cathode discharges may be used to produce such partial coating treatment.

Reference will now be made in detail to the present preferred embodiments of the present invention, examples of which are illustrated in the accompanying drawings. Similar or identical structure is labeled using identical callouts. Turning now to the FIGURES, FIG. 1 is a schematic representation of a side view of one embodiment of apparatus, 10, of the present invention for selective removal of coatings by exposure to reactive species produced by a plasma generated by cylindrical electrodes. It should also be mentioned that although the method and apparatus of the present invention will be described throughout using coating removal as the process performed using the plasma, other coating treatments using the plasma are also anticipated. Process chamber, 12, which may be operated at atmospheric pressure or under vacuum, has ports, 14*a* and 14*b*, through which the fabric, 16, enters and exits chamber 12, respectively. Fabric 16, which has a previously applied coating, is shown being pulled against rotatable grounded electrode, impermeable cylinder, 18, which rotates about axis, 20. Plasma, 22, is struck, typically between electrode 18 and concentric electrode, 24, which may be powered by alternating electrical current or radio-frequency power supply, 26, the output of which enters chamber 12 through feedthrough, 28. Feed gas, 30, enters chamber 12 through tube, 32 which also passes through feedthrough 28. Tube 32 is connected to a supply of compressed gas (not shown), and if the plasma is operated in a partial vacuum, then a gas-tight seal would be made where feed-through, 28, enters chamber, 12. Electrical connection, 34, to electrode 24 is shown in FIG. 1; however, electrode 18 may be powered if electrode 24 is grounded. Power supply 26 may provide ac power typically in the range between 50 KHz and 100 MHz, at a power density between 10 and 100 W/in.$^2$. Frequencies of 13.56 and 27.1 MHz have been tested and found useful in practicing the method of the present invention. It is anticipated that 40.1 MHz will also be useful. Not shown in FIG. 1 is an exhaust for gases produced from fabric coating treatment. These gases may exhaust through ports 14*a* and 14*b* in the case where the plasma is operated at atmospheric pressure.

The diameter of electrode 18 is chosen such that the time the fabric spends exposed to plasma 22 is sufficient for the active species produced in the plasma to fully treat the coating. If the linear speed of the fabric is high and the exposure time to the plasma is too short to treat the coating for a practical electrode diameter, then multiple process chambers may be used to augment the time the fabric spends exposed to plasma, or the linear speed may be reduced. Generally, electrode 18 would be rotated in a continuous fashion; however, it is anticipated that intermittent motions might be used to achieve certain effects. Additionally, the plasma properties, such as intensity, and species present might be altered during a fabric run, also to achieve certain desired effects. For a dielectric barrier discharge, either or both electrodes 18 and 24 would have a dielectric surface coating, such as glass, ceramic or Teflon.

Figure 2:
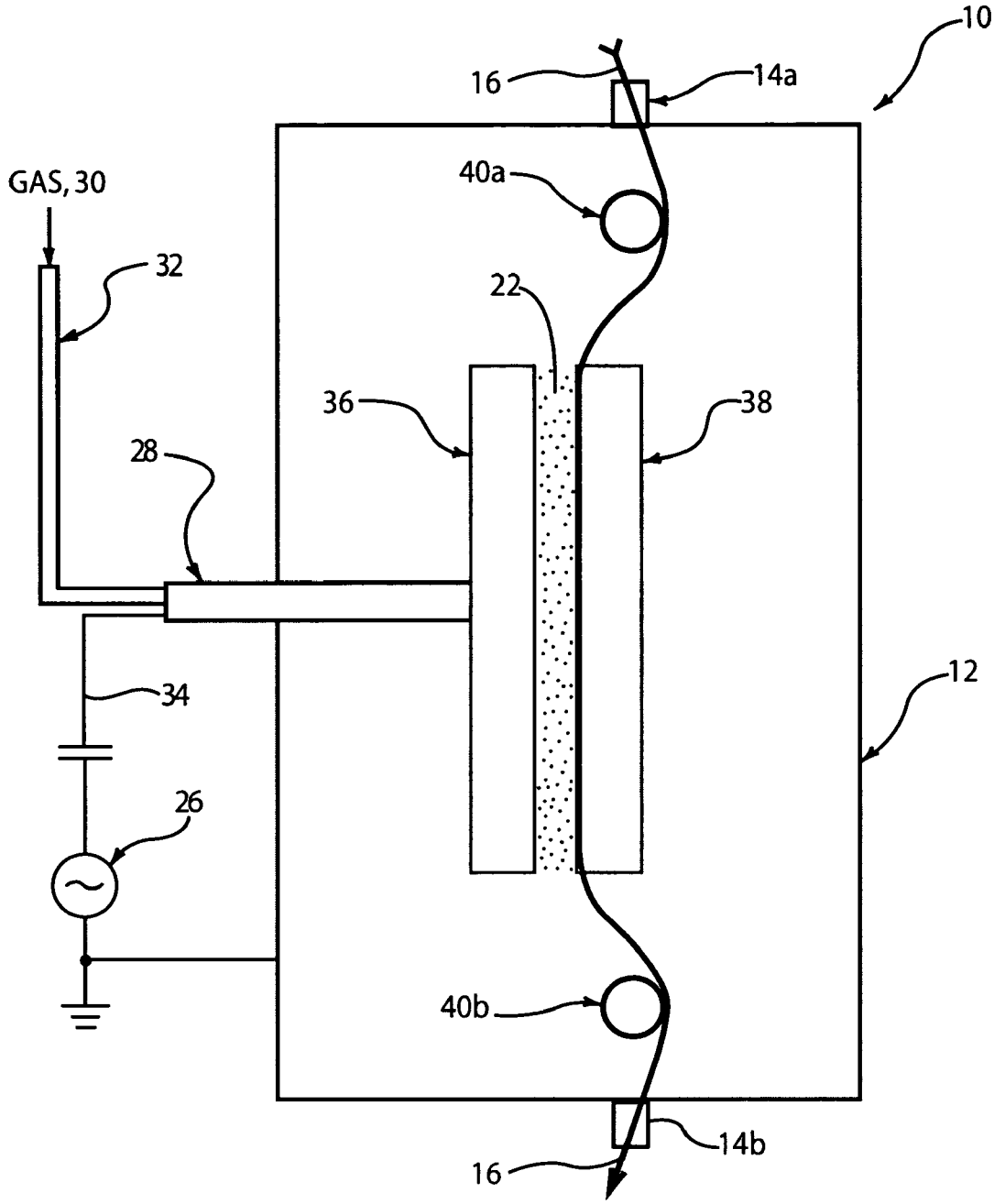
FIG. 2 is a schematic representation of another embodiment of a plasma apparatus for selective removal or treatment of a coating on one side of a fabric coated on both sides, using flat planar electrodes having impermeable surface, wherein the fabric is held against the grounded electrode.

A side view of a second embodiment of the apparatus of the present invention is shown schematically in FIG. 2. Previously-coated fabric 16 enters and exits process chamber 12 through ports, 14*a* and 14*b*, respectively. Planar electrodes, 36 and 38, generate plasma 22. As in FIG. 1, electrical power is supplied to one electrode 36 by radiofrequency generator 26 through wire 34 (shown with capacitive coupling) that enters process chamber 12 through feedthrough 28. Process gases 30 are introduced into process chamber 12 by gas line 32 that also enter process chamber 12 through feedthrough 28. Rollers, 40*a* and 40*b*, keep fabric 16 against electrode (impermeable) surface 38, which may be grounded. Similar to the embodiment shown in FIG. 1 hereof, if the exposure time of the fabric to the plasma is insufficient to fully process the coating from the unprotected side of the fabric, multiple plasma sources or process chambers may be used to increase the total plasma time.

Figure 3:
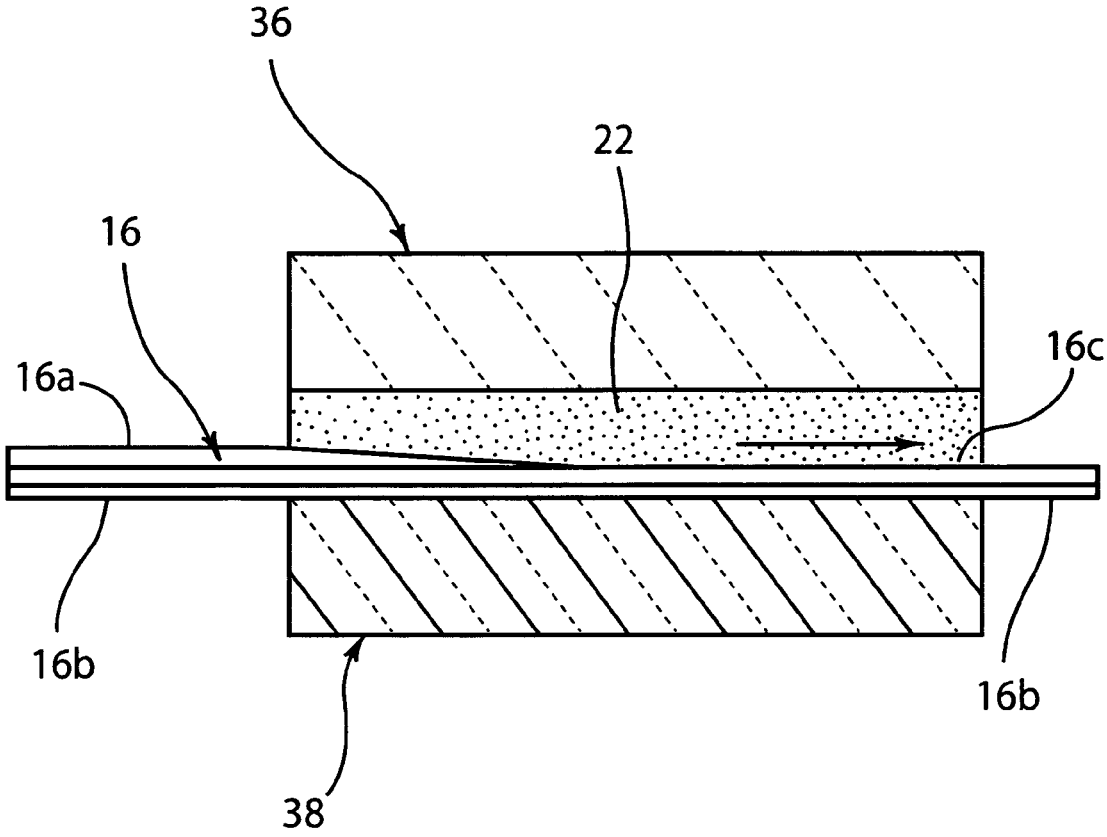
FIG. 3 shows the selective removal of a coating from one side of a fabric coated on both sides using the plasma procedure of the present invention, as the fabric is moved across the plasma; the coating gradually decreases in thickness as the residence time of the exposed coating is increased until it is completely removed, while the coating on the side of the fabric near to or touching the electrode remains substantially unaltered during the passage of the fabric through the plasma.

FIG. 3 shows the time dependence of side-selective coating removal process in accordance with the teachings of the present invention. Fabric 16 is illustrated in an exaggerated size, showing coatings 16*a* and 16*b* initially on both sides thereof. As fabric 16 moves from left to right (arrow) through plasma 22 between planar electrodes 36 and 38, with coating 16*b* of fabric 16 being positioned in close proximity to the gas impermeable surface of electrode 38, coating 16*a*, which is exposed to plasma 22, is etched away exposing bare fabric 16*c*. On the side facing the electrode 38, coating 16*b* remains substantially unaltered throughout the exposure of the fabric to the plasma. Bare fabric 16 may have properties different than those of the coated fabric, and may wick water, as an example, whereas surface 16*b*, may repel water, also as an example.

Figure 4:
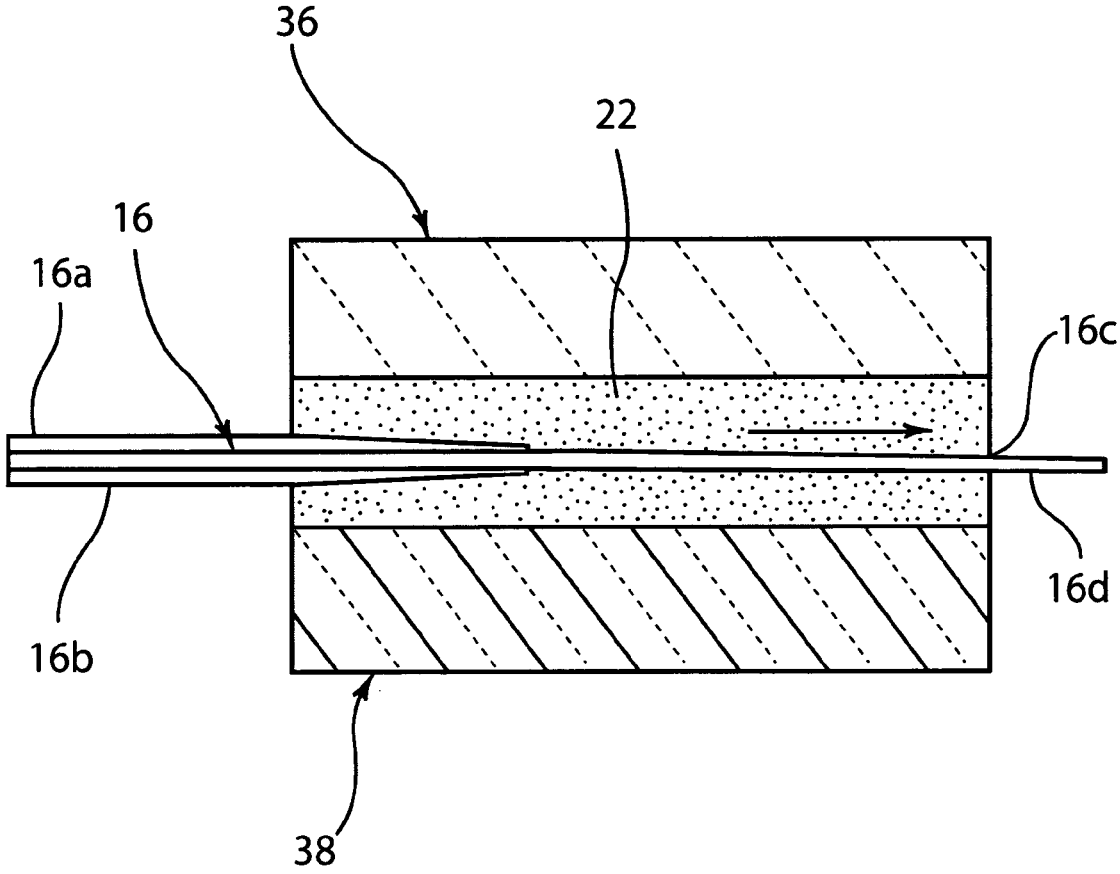
FIG. 4 shows the resulting coating removal by the plasma if the coated fabric is not held near to or against an electrode during passage through the plasma; the coating is removed from both sides of the fabric, thereby exposing the bare fabric.

It should be mentioned that if fabric 16 with coatings 16*a* and 16*b* is not held in the proximity of one of the electrodes, 36 or 38, the result is shown in FIG. 4; both coatings 16*a* and 16*b* are removed substantially equally from both sides of the fabric, thereby exposing bare fabric surfaces 16*c* and 16*d*. The amount of pressure that fabric 16 must be held against a plasma-gas impermeable surface to avoid plasma processing of the side unexposed to the plasma is determined by experiment for the kind of plasma that is employed. That is, under some circumstances, mere proximate location of the coated fabric surface to the impermeable surface will suffice, while in others, contact between the coating and the surface is required.

Figure 5:
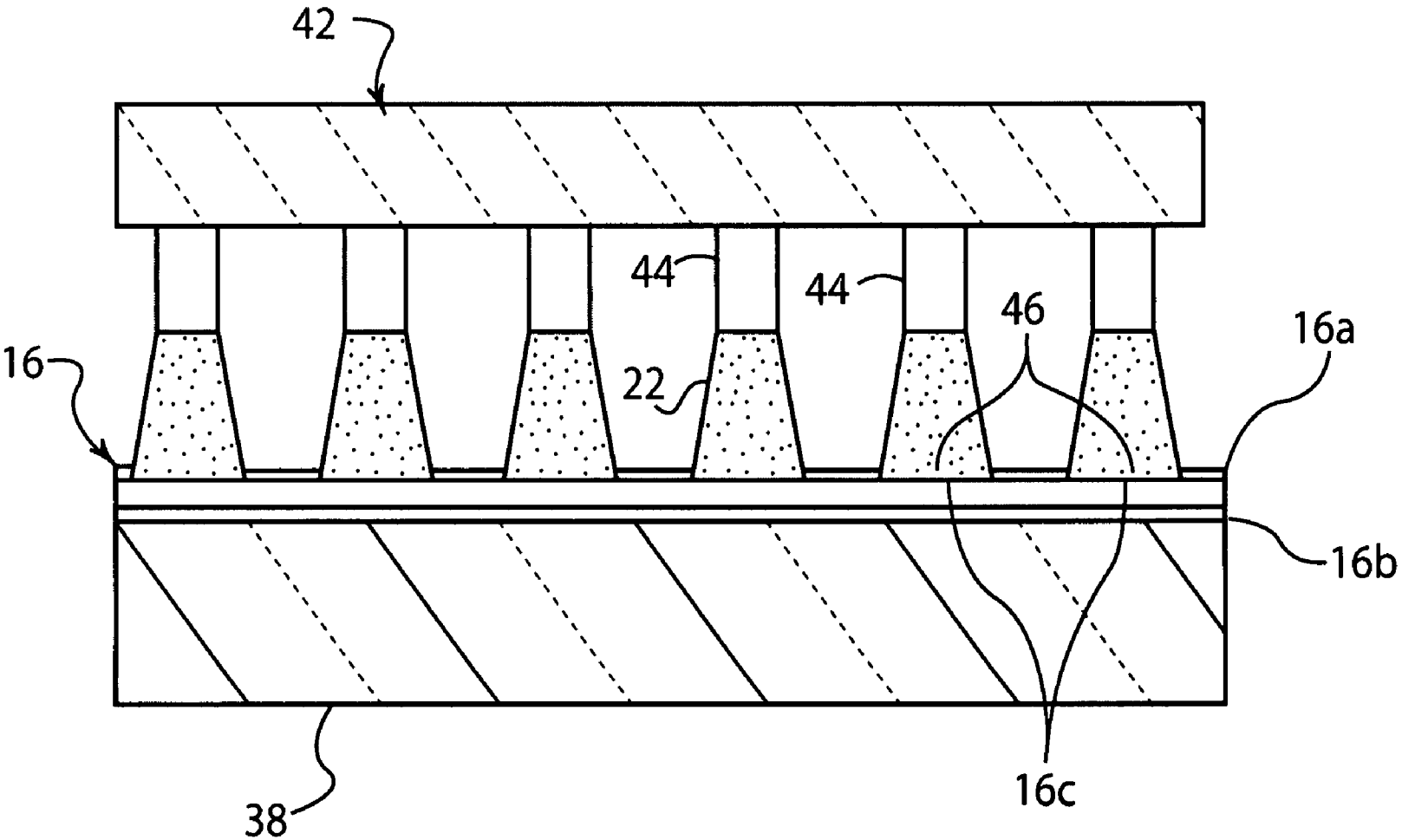
FIG. 5 shows a plasma generated from a plurality of hollow-cathode discharges resulting from the addition of pins (or holes) onto (in) the electrodes; the resultant plasma is enhanced in the vicinity of the pins or holes, which causes the coating exposed to the enhanced plasma to be etched away leaving bare, exposed fabric.

FIG. 5 shows a third embodiment of the plasma apparatus of the present invention in which electrode, 42, may be fitted with a plurality of pins, 44, (or holes; not shown, but equivalent in operation to pins, 44), or may be slotted or grooved. This electrode configuration creates an enhanced plasma, called the hollow-cathode effect, in the vicinity of the pins or grooves 44 which causes faster removal or other coating processing in these localized enhanced regions, 46. Either electrode 38 or 42 in FIG. 5 may be powered, and the other electrode may be grounded. Generally, in order to achieve the most favorable processing results, the protected side of the fabric to be treated is held in the vicinity of or in contact with a flat, plasma-impermeable surface.

Both grounded and powered flat, plasma-impermeable electrodes may be used for this purpose. If the movement of the fabric is directed in or out of the paper in FIG. 5, a strip of coating 16*a* will be removed from the surface of the fabric 16 facing the plasma, leaving exposed strips of bare fabric 16*c*. The fabric may be patterned in this way; alternative designs or shadings (if subsequently dyed) may be performed by varying the structure and shape of electrode 42.

Figure 6:
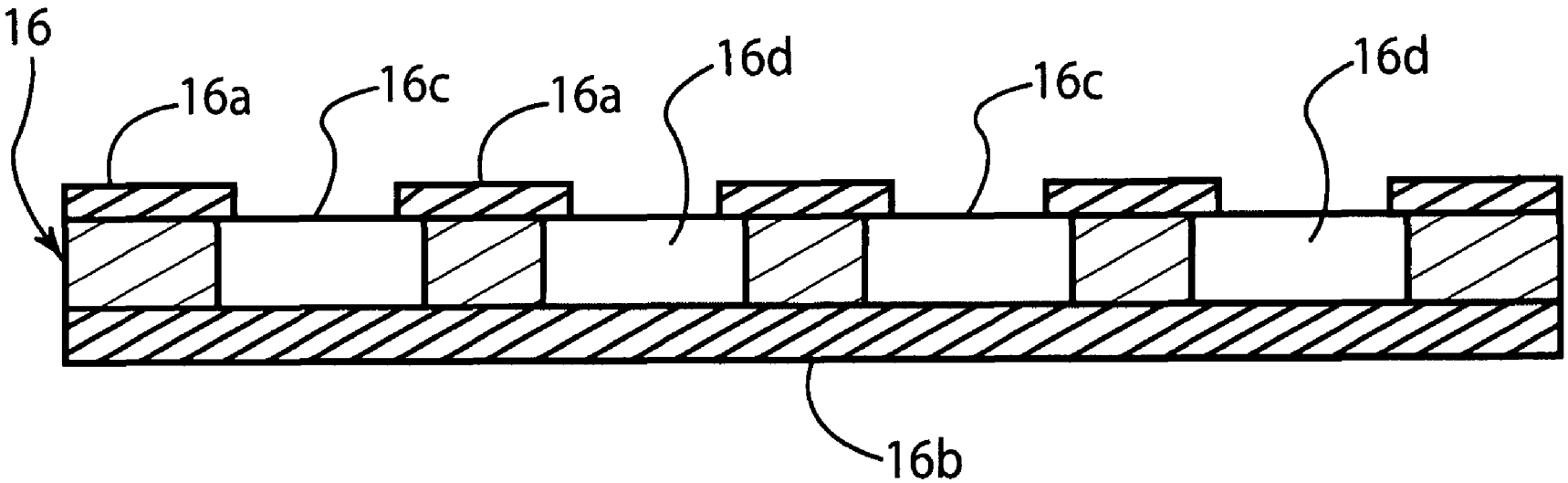
FIG. 6 shows the effect after dyeing upon fabric that has been striped or treated using a dip or padding technique after applying the method shown in FIG. 5 hereof; that is, where hydrophobic coating stripes are present, impregnation of the fabric by the aqueous dye treatment is prevented, while where the coating has been stripped away by the plasma created by the electrode design of FIG. 5, the aqueous dye treatment penetrates the fabric, thereby producing a striped dye pattern.

As an example, if the fabric produced in FIG. 5 originally had a water-repellent coating which was removed in stripes, and the resulting fabric was subsequently dipped into a chemical bath or dye bath, the result is illustrated in FIG. 6. In FIG. 6, hydrophobic coating 16*a* prevents absorption of dye or aqueous chemicals from the side that was facing the electrode of impermeable surface in FIG. 5. Because strips of bare fabric, 16*c* are produced on the side 16*a* of fabric 16 that was facing enhanced plasma 46 in FIG. 5, absorption of the liquid will occur in these regions, leading to dyed or treated sections, 16*d*. This patterning may be used for fashion design. It should be mentioned that some horizontal migration of the chemicals used in the treatment is expected and shown in FIG. 6. By having an alternating presence, it should be easier to visually observe a regular, colorimetric changes in the fabric, and coating 16*b* on the side of the fabric worn against a user's body, may serve to protect the wearer from exposure to the chemicals used to impregnate the fabric.

It should be mentioned that FIGS. 3, 4 and 5 do not show the electrical or gas connections, since these may be the same as those for FIGS. 1 and 2. Also, not shown are the process chamber and means for moving the fabric across the electrode. Having generally described the present apparatus, the operation thereof is described in the following EXAMPLES.

EXAMPLE 1

TABLE 1 illustrates process gases (in all cases He was the majority gas), radio frequency power, hydrophobic coatings, residence time in the plasma and the measurements of hydrophobicity and hydrophilicity for several samples of 100% cotton bottomweight fabric previously treated with a stain repel/release material (DuPont HT or Nanotex), exposed to a plasma in accordance with the teachings of the present invention. The fabric was held against the ground electrode. To determine the hydrophobicity of a sample, the 3M Water Repellency Test III was used. This test uses differing concentrations of isopropyl alcohol and water to create mixtures having known surface tension. The mixture is then placed on the sample to imitate a penetrating stain, and the sample is rated based on its ability to repel a certain surface tension. Samples with a rating of 12 are the most hydrophobic, and samples rated 0 are the least hydrophobic and will absorb water.

TABLE 1

| Sample | Gas | % Gas | Fabric | Power (W) | Res. Time (sec) | Untreated | Front | Back | |
|---|---|---|---|---|---|---|---|---|---|
| 1 | NH3 | 0.06 | Gap Khakis Pant | 800 | 30 | 8 | 4 | 0 | |
| 2 | NH3 | 0.125 | Gap Khakis Pant | 800 | 30 | 8 | 4 | 0 | |
| 3 | NH3 | 0.25 | Gap Khakis Pant | 920 | 60 | 8 | 4 | 0 | |
| 4 | NH3 | 0.125 | Gap Khakis Pant | 450 | 30 | 8 | 5 | 2 | |
| 5 | NH3 | 0.125 | Cambridge Classics Pant | 800 | 25 | 8 | 4 | 0 | |
| 6 | O2 | 0.125 | Cambridge Classics Pant | 800 | 15 | 7 | 6 | 0 | |
| 7 | O2 | 1.0 | Cambridge Classics Pant | 800 | 5 | 7 | 6 | 0 | |
| 8 | O2 | 2.0 | Cambridge Classics Pant | 800 | 5 | 7 | 6 | 0 | |
| 9 | O2 | 3.0 | Cambridge Classics Pant | 1400 | 5 | 7 | 6 | 0 | |
| 10 | O2 | 5.0 | Cambridge Classics Pant | 1400 | 5 | 7 | 6 | 0 | |
| 11 | O2 | 7.0 | Cambridge Classics Pant | 1400 | 5 | 7 | 6 | 0 | |
| 12 | O2 | 3.0 | Cambridge Classics Pant | 1400 | 10 | 7 | 6 | 0 | |
| 13 | O2 | 5.0 | Cambridge Classics Pant | 1600 | 5 | 7 | 6 | 0 | |
| 14 | O2 | 2.0 | Cambridge Classics Pant | 2000 | 5 | 7 | 6 | 0 | |
| 15 | O2 | 3.0 | Cambridge Classics Pant | 2000 | 5 | 7 | 6 | 0 | |
| 16 | O2 | 3.0 | Cambridge Classics Pant | 2000 | 7 | 7 | 7 | 0 | |
| 17 | O2 | 1.0 | Cambridge Classics Pant | 1400 | 5 | 7 | 7 | 5 | * |
| 18 | O2 | 2.0 | Cambridge Classics Pant | 1400 | 5 | 7 | 7 | 5 | * |
| 19 | O2 | 3.0 | Cambridge Classics Pant | 2000 | 3 | 7 | 6 | 5.5 | * |
| 20 | O2 | 3.0 | Cambridge Classics Pant | 2000 | 5 | 7 | 6 | 7 | * |
| 21 | O2 | 3.0 | Cambridge Classics Pant | 2000 | 7 | 7 | 6 | 14 | * |
| 22 | O2 | 3.0 | Cambridge Classics Pant | 2000 | 9 | 7 | 6 | 22 | * |

TABLE 1-continued

| Sample | Gas | % Gas | Fabric | Power (W) | Res. Time (sec) | Untreated | Front | Back | |
|---|---|---|---|---|---|---|---|---|---|
| 23 | O2 | 1.0 | Cambridge Classics Pant | 2000 | 3 | 7 | 6 | 6 | * |
| 24 | O2 | 1.0 | Cambridge Classics Pant | 2000 | 5 | 7 | 6 | 9 | * |
| 25 | O2 | 1.0 | Cambridge Classics Pant | 2000 | 7 | 7 | 6 | 10.5 | * |
| 26 | O2 | 1.0 | Cambridge Classics Pant | 2000 | 9 | 7 | 6 | 13 | * |
| 27 | O2 | 5.0 | Cambridge Classics Pant | 2000 | 3 | 7 | 6 | 6.5 | * |
| 28 | O2 | 5.0 | Cambridge Classics Pant | 2000 | 5 | 7 | 6 | 25 | * |
| 29 | O2 | 5.0 | Cambridge Classics Pant | 2000 | 7 | 7 | 6 | 25 | * |
| 30 | O2 | 5.0 | Cambridge Classics Pant | 2000 | 9 | 7 | 6 | 25 | * |
| 31 | O2 | 3.0 | Dockers Prostyle Shirt | 2000 | 3 | 4 | 0 | 15 | * |
| 32 | O2 | 3.0 | Dockers Prostyle Shirt | 2000 | 5 | 4 | 0 | 20.5 | * |
| 33 | O2 | 3.0 | Dockers Prostyle Shirt | 2000 | 7 | 4 | 0 | 25 | * |
| 34 | O2 | 3.0 | Dockers Prostyle Shirt | 2000 | 9 | 4 | 0 | 25.5 | * |
| 35 | O2 | 3.0 | Dockers Prostyle Shirt | 2000 | 1 | 4 | 1 | 6.5 | * |
| 36 | O2 | 3.0 | Dockers Prostyle Shirt | 1000 | 3 | 4 | 0 | 7.5 | * |
| 37 | O2 | 3.0 | Dockers Prostyle Shirt | 800 | 3 | 4 | 0 | 6.5 | * |
| 38 | O2 | 1.0 | Dockers Prostyle Shirt | 500 | 3 | 4 | 0 | 5 | * |
| 39 | O2 | 0.125 | Dockers Prostyle Shirt | 500 | 3 | 4 | 4 | 5 | * |
| 40 | O2 | 0.125 | Dockers Prostyle Shirt | 500 | 5 | 4 | 4 | 5 | * |
| 41 | O2 | 0.5 | Dockers Prostyle Shirt | 500 | 5 | 4 | 0 | 5 | * |
| 42 | O2 | 0.25 | Dockers Prostyle Shirt | 500 | 5 | 4 | 0 | 5 | * |
| 43 | O2 | 3.0 | Cambridge Classics Pant | 2000 | 7 | 7 | 6 | 0 to 6 | |
| 44 | O2 | 0.125 | Dockers Prostyle Shirt | 500 | 3 | 4 | 4 | 0 to 4 | |
| 45 | O2 | 3.0 | Cambridge Classics Pant | 350 | 3 | 7 | ARC | ARC | |
| 46 | NO SAMPLE | | | | | | | | |
| 47 | NO SAMPLE | | | | | | | | |
| 48 | O2 | 6.0 | Cambridge Classics Pant | 400 | 3 | 7 | FABRIC BURN | | |
| 49 | O2 | 6.0 | Cambridge Classics Pant | 675 | 3 | 7 | FABRIC BURN | | |
| 50 | O2 | 6.0 | Cambridge Classics Pant | 675 | 5 | 7 | FABRIC BURN | | |
| 51 | O2 | 3.0 | Haggar Freedom Pant | 330 | 3 | 5 | 4 | 7.5 | * |
| 52 | O2 | 3.0 | Haggar Freedom Pant | 330 | 5 | 5 | 4 | 18 | * |
| 53 | O2 | 3.0 | Haggar Freedom Pant | 240 | 5 | 5 | 4 | 17 | * |
| 54 | O2 | 3.0 | Haggar Freedom Pant | 240 | 3 | 5 | 4 | 10 | * |
| 55 | NO SAMPLE | | | | | | | | |
| 56 | NO SAMPLE | | | | | | | | |
| 57 | NO SAMPLE | | | | | | | | |
| 58 | O2 | 3.0 | Cambridge Classics Pant | 330 | 3 | 7 | 4 | 0 | * |
| 59 | O2 | 3.0 | Cambridge Classics Pant | 330 | 5 | 7 | 4 | 5 | * |

*Indicates water drop adsorption diameter in millimeters after 5 s. All fabrics with a '*' are a zero by the 3M rating system.
Gap Khakis Pant is treated with Nano-care
Dockers Prostyle Shirt is treated with 'Stain Defender', 'Colorbond', and 'No Wrinkles'
Cambridge Classics Pant is treated with Dupont Teflon HT
Teflon is a registered trademark of DuPont Company.
Dockers is a registered trademark of Levi Strauss and Co.
Haggar is a registered trademark of Haggar Clothing Co.

TABLE 2 shows hydrophobic properties of 100% cotton bottomweight fabric previously treated with DuPont HT or Nanotex, before and after plasma treatment for both sides of the fabric, when the fabric is or is not held against the electrode. Comparable results, within experimental error are obtained for the side facing the plasma and the side facing the ground electrode, depending on the distance from the electrode.

TABLE 2

| | Before Plasma | | After Plasma | |
|---|---|---|---|---|
| | Front | Back | Front | Back |
| Fabric tight against electrode | 7 | 7 | 6 | 0 |
| Fabric loose against electrode | 7 | 7 | 0 | 0 |

EXAMPLE 2

Water droplets were observed on a fabric previously treated with the DuPont HT repel/release materials, after exposure for 5 s to the plasma of the present invention. One side was held against the electrode, and the other side faced the plasma. The shielded side showed that a water drop beaded up on the fabric, whereas for the side facing the plasma, water wicks into the fabric. Spatially-specific plasma treatment was seen where the plasma was restricted to a portion of the fabric. Where the fabric was exposed to the plasma, water wicked into the fabric, whereas when water was dripped onto a part of the fabric not modified by the plasma, it was observed to bead.

In addition to the results demonstrated for twill trouser, bottomweight fabric, the same process may be used for topweight; shirt material; home furnishings, such as curtains and top-of-the-bed materials; nonwoven materials and carpeting, as examples.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for selectively processing a one side of a two-sided textile or a two-sided nonwoven material, comprising the steps of:

generating reactive chemical species using a low-temperature plasma proximate to the chosen side of the textile or nonwoven material and effective for processing the chosen side of the textile or nonwoven material;

exposing the chosen side of the textile or nonwoven material to the plasma for a period of time effective for processing the chosen side; and maintaining the second side of the textile or nonwoven material in proximity to a plasma impermeable surface, wherein the low-temperature plasma is generated using a radiofrequency discharge between two electrodes, a first electrode being grounded, and a second electrode being powered.

2. The method of claim 1, wherein said step of exposing the chosen side of the textile or nonwoven material is achieved by moving the textile or nonwoven material through the reactive chemical species.

3. The method of claim 1, wherein said processing comprises removing a coating from the chosen side of the textile or nonwoven material.

4. The method of claim 3, wherein said reactive chemical species are generated from a gas mixture comprising helium and oxygen.

5. The method of claim 3, wherein said reactive chemical species are generated from a gas mixture comprising helium and ammonia.

6. The method of claim 1, wherein the plasma-impermeable surface comprises the grounded electrode.

7. The method of claim 6, wherein the second side of the textile or the nonwoven material is placed in contact with the grounded electrode.

8. The method of claim 1, wherein the plasma-impermeable surface comprises the powered electrode.

9. The method of claim 8, wherein the second side of the textile or the nonwoven material is placed in contact with the powered electrode.

10. The method of claim 1, wherein the radiofrequency discharge is driven by radiofrequency energy between 50 KHz and 100 MHz.

11. The method of claim 1, wherein the low-temperature plasma is enhanced in selected regions using a radiofrequency hollow-cathode effect between a powered electrode and a grounded electrode.

12. The method of claim 11, wherein the plasma-impermeable surface comprises the grounded electrode.

13. The method of claim 12, wherein the textile or the nonwoven material is placed in contact with the grounded electrode.

14. The method of claim 11, wherein the plasma-impermeable surface comprises the powered electrode.

15. The method of claim 14, wherein the textile or the nonwoven material is placed in contact with the powered electrode.

16. The method of claim 11, wherein the radiofrequency discharge is driven by radiofrequency energy between 50 KHz and 100 MHz.

17. The method of claim 11, wherein the selected regions are spaced apart such that a pattern is formed on the chosen side of the coated fabric or coated nonwoven material.

* * * * *